US012092344B2

(12) United States Patent
Anderson

(10) Patent No.: US 12,092,344 B2
(45) Date of Patent: Sep. 17, 2024

(54) CONTROLLING HOT WATER RECIRCULATION

(71) Applicant: Dale Lee Anderson, Fallbrook, CA (US)

(72) Inventor: Dale Lee Anderson, Fallbrook, CA (US)

( * ) Notice: Subject to any disclaimer, the term of this patent is extended or adjusted under 35 U.S.C. 154(b) by 0 days.

(21) Appl. No.: 17/879,336

(22) Filed: Aug. 2, 2022

(65) Prior Publication Data

US 2023/0116017 A1 Apr. 13, 2023

Related U.S. Application Data

(60) Provisional application No. 63/228,430, filed on Aug. 2, 2021.

(51) Int. Cl.
*F24D 17/00* (2022.01)
*F24D 19/10* (2006.01)

(52) U.S. Cl.
CPC ..... *F24D 17/0078* (2013.01); *F24D 19/1051* (2013.01)

(58) Field of Classification Search
CPC ..... F24D 19/1051
See application file for complete search history.

(56) References Cited

U.S. PATENT DOCUMENTS

| | | | | |
|---|---|---|---|---|
| 4,936,289 | A * | 6/1990 | Peterson | F24D 17/0078 122/13.3 |
| 9,234,664 | B1 * | 1/2016 | Hayner | F24D 19/1051 |
| 9,513,019 | B2 * | 12/2016 | Acker | F24H 15/281 |
| 10,215,424 | B2 * | 2/2019 | Acker | F24H 15/281 |
| 11,421,896 | B1 * | 8/2022 | McCain | F24D 19/1066 |
| 11,592,190 | B2 * | 2/2023 | Kaufman | F24D 19/1051 |
| 2010/0096018 | A1 * | 4/2010 | Wylie | F24H 15/335 137/337 |
| 2010/0251974 | A1 * | 10/2010 | Showen | E03B 7/04 122/14.3 |
| 2016/0223209 | A1 * | 8/2016 | Lehrian | F24D 17/0078 |
| 2021/0095866 | A1 * | 4/2021 | Chaudhry | F24D 19/1051 |
| 2022/0170246 | A1 * | 6/2022 | Pallauta Pérez | E03B 7/04 |

FOREIGN PATENT DOCUMENTS

| | | | | |
|---|---|---|---|---|
| EP | 3653941 | B1 * | 9/2021 | E03B 7/045 |
| GB | 2591215 | A * | 7/2021 | F24D 17/0078 |

* cited by examiner

*Primary Examiner* — Gregory A Wilson
(74) *Attorney, Agent, or Firm* — Chang & Hale LLP

(57) ABSTRACT

The present disclosure provides for a recirculating flow controller that is operably coupled to a flow switch and to a recirculation pump. The recirculating flow controller determines that hot water has begun to flow by way of the connection with the flow switch. In response, the recirculating flow controller activates the recirculation pump to circulate hot water from a water heater. The recirculating flow controller can activate the recirculation pump for a predetermined duration. The flow switch can be configured to sense flow in a hot water line connected to a water heater. The flow switch can be activated by turning on any hot water faucet connected to the water heater.

17 Claims, 8 Drawing Sheets

CONTROLLING HOT WATER RECIRCULATION

CROSS-REFERENCE TO RELATED APPLICATION

This application claims the benefit of priority to U.S. App. No. 63/228,430 filed Aug. 2, 2021 and entitled "CONTROLLING HOT WATER RECIRCULATION," the entire contents of which is incorporated by reference herein for all purposes.

BACKGROUND

Field

The present disclosure generally relates to hot water recirculating systems.

Description of Related Art

Hot water recirculating systems are designed to supply users with hot water on demand or nearly instantaneous hot water. A recirculation pump is typically used in pumping hot water directly from a water heater through a hot-water pipeline. At the same time, it returns or recirculates water that has cooled back to the water heater for reheating. Typical recirculating systems can come with a timer that automatically turns on the recirculation pump at regular or set intervals, particularly during peak water usage times. Some recirculating systems can be activated by smartphone applications and/or dedicated buttons or switches installed on the premises.

SUMMARY

The present disclosure provides for a recirculating flow controller that is operably coupled to a flow switch and to a recirculation pump. The recirculating flow controller determines that hot water has begun to flow by way of the connection with the flow switch. In response, the recirculating flow controller activates the recirculation pump to circulate hot water from a water heater. The recirculating flow controller can activate the recirculation pump for a predetermined duration. The predetermined duration can be programmed into the recirculating controller. The predetermined duration can be changed through interaction with the recirculating controller. The flow switch can be configured to sense flow in a hot water line connected to a water heater. In some embodiments, the flow switch provides an open circuit responsive to no flow in the hot water line and a closed circuit responsive to non-zero flow in the hot water line.

To trigger activation of the recirculation pump, a user can briefly turn on any hot water faucet connected to the water heater. This causes water to flow through the water heater, which in turn affects the flow switch (e.g., causes the flow switch to form a closed circuit). The change in the flow switch is detected by the recirculating flow controller, which in turn activates the recirculation pump. After a recirculation program (e.g., a timed program) is completed, the recirculating flow controller deactivates the recirculation pump. The recirculation program can be configured to run for a sufficient amount of time to move hot water to some or all of the hot water fixtures connected to the water heater. During the recirculation program, the user can turn off the hot water faucet and the recirculation pump will continue to operate until the recirculation program terminates. Once the recirculation program is complete, the user can then turn on the hot water faucet again to dispense hot water from the water faucet. Thus, the user can briefly turn on the hot water faucet to activate the recirculation system so that hot water is available when desired (e.g., after the predetermined duration).

In some aspects, the techniques described herein relate to a hot water recirculation system including: a flow switch operably coupled to a hot water line and configured to change state to indicate water flow in the hot water line; a recirculation pump configured to circulate water through a return line to a water heater; and a recirculating flow controller operably coupled to the flow switch and to the recirculation pump, the recirculating flow controller configured to activate the recirculation pump responsive to the flow switch changing state to indicate water flow in the hot water line.

In some aspects, the techniques described herein relate to a system wherein the state change of the flow switch corresponds to changing between an open circuit and a closed circuit. In some aspects, the techniques described herein relate to a system wherein the state change of the flow switch corresponds to providing an electric signal to the recirculating flow controller.

In some aspects, the techniques described herein relate to a system further including a switch cable that connects the flow switch to the recirculating flow controller. In some aspects, the techniques described herein relate to a system further including a pump cable that connects the recirculation pump to the recirculating flow controller.

In some aspects, the techniques described herein relate to a system wherein the recirculating flow controller is configured to pass power received from a wall outlet to the recirculation pump to activate the recirculation pump.

In some aspects, the techniques described herein relate to a system wherein the recirculating flow controller is configured to activate a recirculation program responsive to the flow switch changing state. In some aspects, the techniques described herein relate to a system wherein the recirculation program includes activating the recirculation pump after a predetermined amount of time. In some aspects, the techniques described herein relate to a system wherein the recirculation program includes deactivating the recirculation pump after a predetermined amount of time. In some aspects, the techniques described herein relate to a system wherein the recirculation program includes running the recirculation pump for a predetermined amount of time.

In some aspects, the techniques described herein relate to a method for recirculating hot water, the method including: sensing a flow of water in a hot water pipe; responsive to sending the flow of water, activating a recirculation pump coupled to a water recirculation system that includes the hot water pipe; and deactivating the recirculation pump according to a recirculation program.

In some aspects, the techniques described herein relate to a method, wherein the recirculation program includes a timed duration for running the recirculation pump. In some aspects, the techniques described herein relate to a method, wherein the timed duration is greater than 1 minute. In some aspects, the techniques described herein relate to a method, wherein the timed duration is less than 10 minutes. In some aspects, the techniques described herein relate to a method, wherein the recirculation program includes a predetermined amount of time to wait between sensing the flow of water and activating the recirculation pump.

For purposes of summarizing the disclosure, certain aspects, advantages and novel features have been described herein. It is to be understood that not necessarily all such advantages may be achieved in accordance with any particular embodiment. Thus, the disclosed embodiments may be carried out in a manner that achieves or optimizes one advantage or group of advantages as taught herein without necessarily achieving other advantages as may be taught or suggested herein.

DETAILED DESCRIPTION OF SOME EMBODIMENTS

Figure 1A:
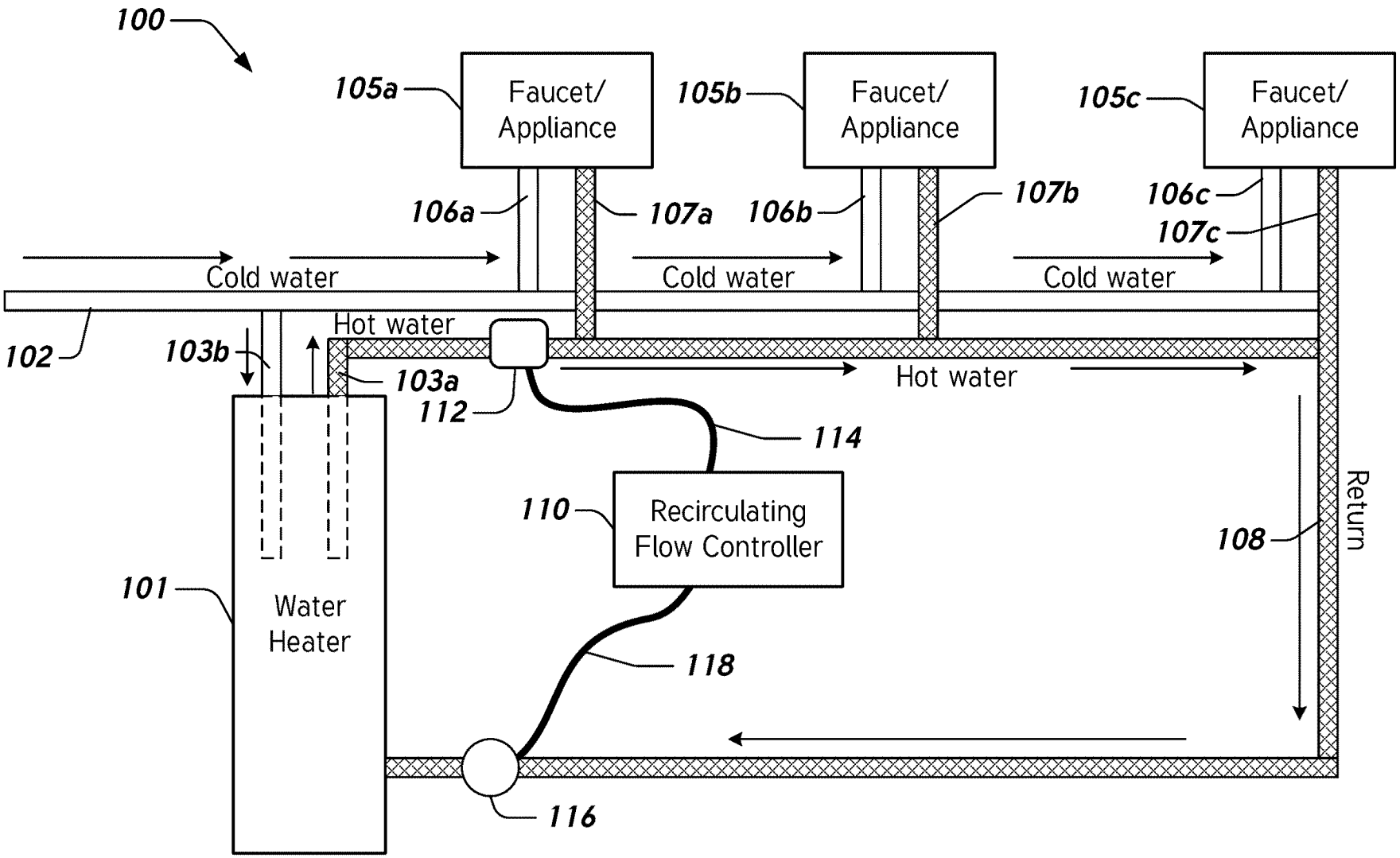
FIGS. 1A and 1B illustrate examples of a recirculating flow controller in a system that provides hot water to a number of faucets and/or appliances.

Hot water recirculating systems include a hot water recirculation pump that is designed to provide hot water with effectively little or no delay when a user desires it. Typical recirculating systems may include a recirculation pump that is installed near a water heater. The recirculation pump intermittently or continuously pumps hot water through the hot water pipes in a house, creating a loop. The hot water continues to circulate through the hot water pipes and dedicated return pipes. In such cases, hot water is instantly available on demand. However, this may be wasteful because hot water is circulating even when no hot water is being requested or used. This may also inflict unnecessary stress on the plumbing.

Other typical systems include a recirculation pump and a crossover valve. In such systems, the recirculation pump can be located over the water heater and the crossover valve can be located under a particular water fixture such as the furthest sink from the water heater, a particular shower, or other faucet or tap in a home. Hot water is pressurized by the recirculation pump through the hot line, through the crossover valve, and into the cold line to create a loop back to the water heater. The hot water can be intermittently or continuously circulated in these types of systems to provide hot water on demand. Other typical systems include a recirculation pump that is located under a particular water fixture (e.g., a sink) that pushes hot water through a crossover valve and into a cold line leading back to the water heater, providing hot water on demand. Again, however, such systems are energy inefficient and may cause undue stress on the plumbing (e.g., speeding up corrosion).

Prior solutions to providing hot water on demand in an energy efficient way typically utilize a user-facing element that interfaces with the recirculation pump that enables a user to turn on the recirculation pump. These user-facing elements may incorporate a complicated user interface, such as smartphone application, or require the installation of a button somewhere in the home that is operated manually or by radio frequency. This may be undesirably complex or inconvenient for the user and/or may be difficult and expensive to install. Other prior solutions involve installing a timer that activates and deactivates the recirculation pump at set times throughout the day. This may be undesirable, however, because it is not easy to adjust the timer to accommodate varying schedules or demands.

Thus, typical solutions for providing hot water have issues with wasting energy (e.g., using a recirculation pump when no hot water is required), with wasting water (e.g., where no recirculation system exists a user may run the faucet until hot water is available), or with generating annoying sounds (e.g., tankless water heaters that run intermittently). Accordingly, disclosed herein are hot water recirculating systems that include a recirculating flow controller that is operably coupled to a flow switch that enables detection of hot water flow. In response to hot water flow, the recirculating flow controller activates a recirculation pump for a programmed duration to deliver hot water to a targeted faucet and/or to most or all hot taps in the home. Once the programmed duration is over, the recirculating flow controller deactivates the recirculation pump. Hot water flow can be initiated by turning on any hot water faucet in the house or a hot water faucet in a targeted location (e.g., a particular bathroom or a particular water fixture).

The disclosed hot water recirculation methods and systems advantageously provide a simple solution for providing hot water on demand. It is simple for a user because a user can initiate the process by momentarily turning on a hot water faucet. There are no smartphone applications required and no dedicated button required to be pushed (which may be located in an inconvenient place). It is simple to install because it interfaces with existing or pre-installed circulation pumps. There is no requirement to install a user interface such as a switch or button in the house as it is activated by existing faucets. The flow switch can be installed in any hot water line or cold line entering the water heater to sense the flow of hot water triggered by any hot water faucet in the house. In certain embodiments, the flow switch can be installed at a particular faucet so that activation of that faucet triggers the recirculation pump through the recirculating flow controller, as described in greater detail herein.

Figure 1B:
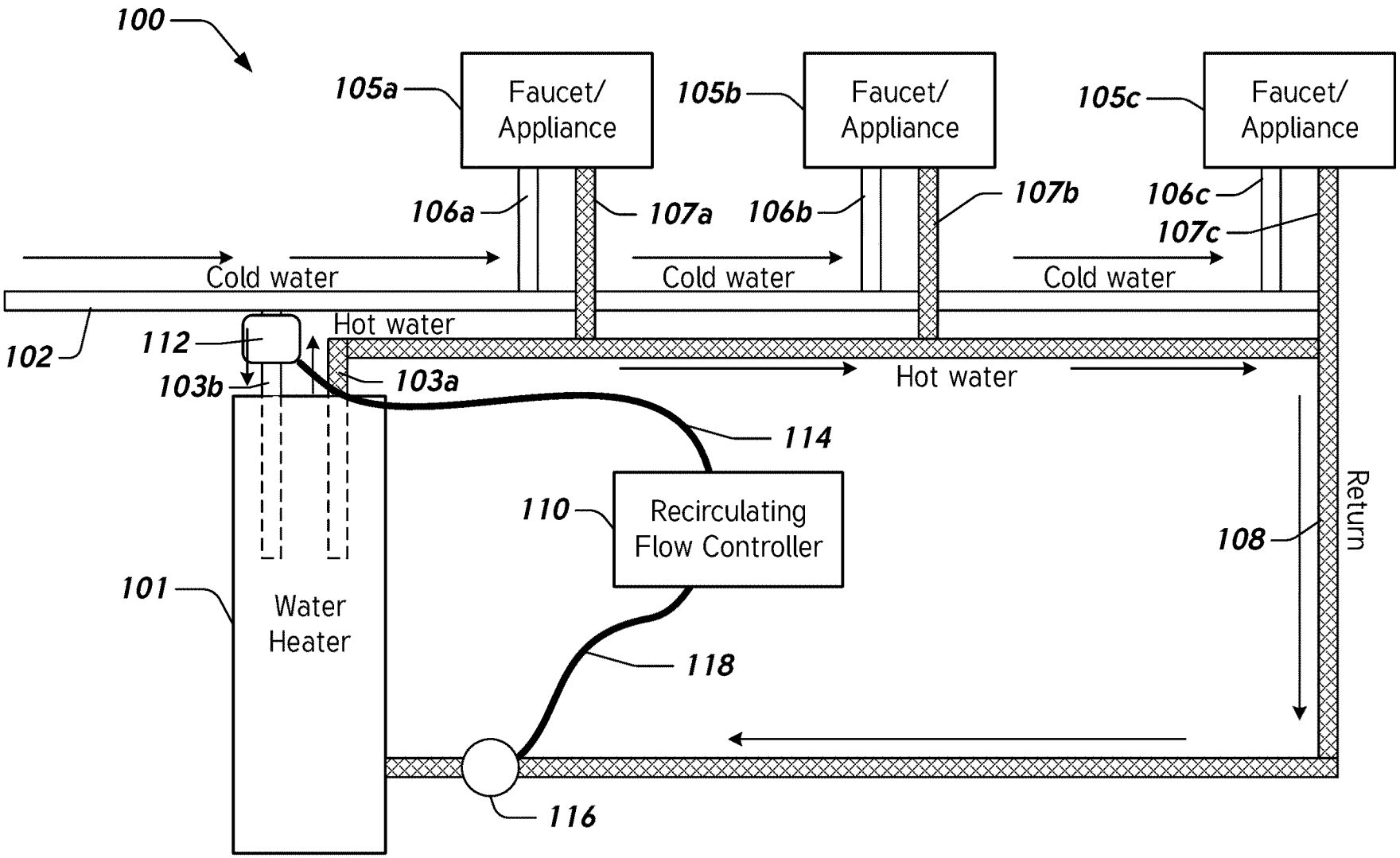

FIGS. 1A and 1B illustrate examples of a recirculating system 100 (main water supply) that provides hot and cold water to a number of faucets and/or appliances 105*a*, 105*b*, 105*c*, the system 100 including a recirculating flow controller 110. The system 100 includes a water heater 101 that receives cold water at an inlet 102 (e.g., from the city) and that heats the water to provide hot water at a hot water outlet 103*a*. The cold and hot water are circulated through the system 100 to provide hot and cold water to a number of faucets 105*a*-105*c* (e.g., sinks, showers, baths, etc.) and appliances 105*a*-105*c* (e.g., dishwashers, clothes washers, etc.) via individual cold lines 106*a*, 106*b*, 106*c* and hot lines 107*a*, 107*b*, 107*c*. The system 100 includes a return line 108 that can return water to the water heater 101 for re-heating. Water can be moved through the return line 108 via a recirculation pump 116. The recirculation pump can be installed on the return line 108 or on the hot water outlet 103*a* near the water heater 101.

The system 100 includes a flow sensor 112 on the hot water line 103*a* (as illustrated in FIG. 1A) or the cold water inlet 103*b* (as illustrated in FIG. 1B) that is configured to provide a signal related to a flow rate of water flowing through the hot water line 103*a* or the cold water inlet 103*b*. In some implementations, and as described herein, the flow sensor 112 can be implemented using a flow switch wherein a flow switch provides a signal or changes state to indicate a flow rate above a threshold in the pipe to which it is coupled.

The signal from the flow sensor 112 is detected or received by the recirculating flow controller 110 through the flow switch cable 114. Responsive to receiving a signal from the flow sensor 112 (or responsive to detecting a change in state of the flow switch), the recirculating flow controller 110 activates the recirculation pump 116 by sending power or other electrical signal over a pump cable 118.

The recirculating flow controller 110 operates according to a recirculation program. The recirculation program can be a timed program wherein responsive to the program initiating (e.g., detecting the change in state in the flow sensor 112 or receiving the signal from the flow sensor 112), the recirculating flow controller 110 activates the recirculation pump 116 and responsive to the recirculation program terminating (e.g., reaching the end of a predetermined duration), the recirculating flow controller 110 deactivates or shuts off the recirculation pump 116. In some implementations, activating the recirculation pump 116 can be accomplished by turning on power or providing power using the pump cable 118 or sending an activation signal over the pump cable 118. In some implementations, deactivating the recirculation pump 116 can be accomplished by turning off power to the pump cable 118 or sending a shut off signal over the pump cable 118. While activated, the recirculation pump 116 keeps hot water circulating through the hot water pipe to provide fast hot water to the faucets/appliances 105*a*-105*c*.

In some embodiments, the flow sensor 112 operates via a change in state, such as an open or closed circuit, such as where the flow sensor 112 is implemented as a flow switch. For example, where there is no water flow in the line or pipe to which the flow sensor 112 is coupled (or water flow below a threshold flow rate), the flow sensor 112 presents an open circuit to the recirculating flow controller 110 over the flow switch cable 114. Similarly, where there is water flow (or a flow rate above a threshold flow rate), the flow sensor 112 presents a closed circuit to the recirculating flow controller 110 over the flow switch cable 114. The recirculating flow controller 110 can detect this change in state by applying a voltage to the flow switch cable 114 and detecting when the flow switch cable 114 is part of an open circuit (e.g., no water flow or water flow below a threshold) or a closed circuit (e.g., water flow or water flow above a threshold).

The flow sensor 112 can be installed on the hot water pipe 103*a* or the cold water inlet 103*b* so that any hot water draw (or a flow rate above a threshold flow rate) causes the recirculating flow controller 110 to activate the recirculation pump 116. Thus, a user can turn on any of the faucets 105*a*-105*c* to initiate hot water recirculation. Furthermore, because the recirculating flow controller 110 operates according to a recirculation program, the faucet does not need to remain on to cause hot water to be recirculated. Consequently, a user can turn on any faucet 105*a*-105*c*, immediately turn that faucet off, wait for a little while, and then turn on any other faucet 105*a*-105*c* (including the same one used to initiate recirculation) and have immediate or prompt access to hot water.

The system 100 advantageously provides reliable access to hot water without many of the disadvantages of typical systems that constantly or intermittently recirculate hot water. This is because the system 100 recirculates hot water on demand without relying on user interface features installed specifically to trigger recirculation (such as a dedicated button or switch or smartphone application).

Figure 2A:
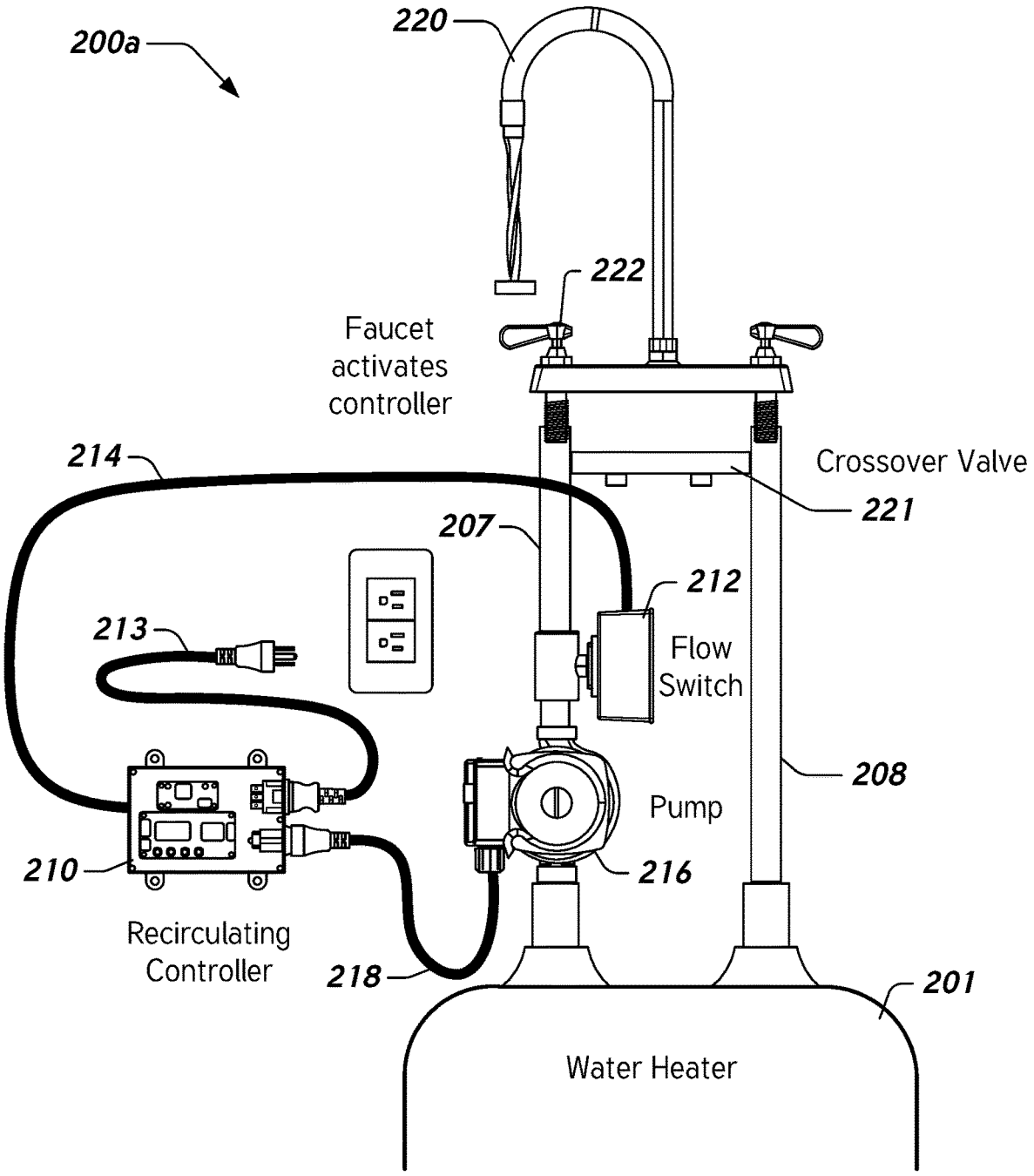
FIGS. 2A and 2B illustrate a recirculating flow controller coupled to a flow switch and a recirculation pump that is activated by turning on a single hot water faucet anywhere in the system.
Figure 2B:
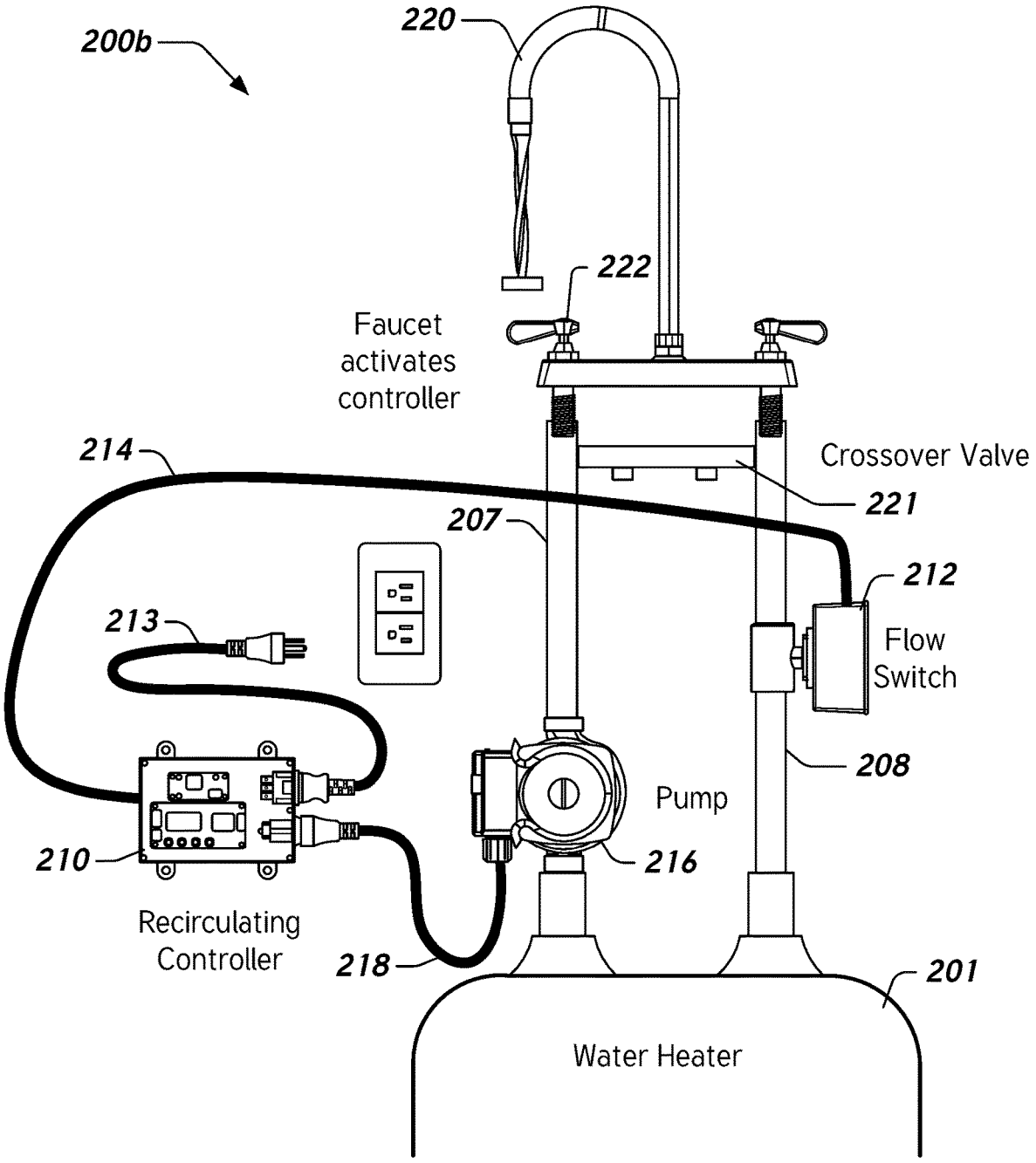

FIGS. 2A and 2B illustrate recirculating flow control systems 200*a*, 200*b* that each include a recirculating flow controller 210 coupled to a flow switch 212 and a recirculation pump 216 that is activated by turning on a hot water tap 222 at a faucet 220. The recirculating flow controller 210 is operably coupled to the flow switch 212 via a flow switch cable 214 and is operably coupled to the recirculation pump 216 via a pump cable 218, as described herein. The flow switch 212 is similar to the flow sensor 112, described herein with reference to FIG. 1. The flow switch 212 senses water flow through the hot water line 207 when a user turns the hot water tap 222. In response, the recirculating controller 210 turns on the recirculation pump 216 according to a recirculation program (e.g., for a set duration). The recirculation pump 216 then operates according to the recirculation program even when the hot water tap 222 has been turned off. The recirculating flow controller 210 turns off the recirculation pump 216 at the end of the recirculation program. As a result, hot water is available at the faucet 220. In some embodiments, hot water may also be available to other faucets in the home or building. Power can be provided to the recirculating flow controller 210 via a power cable 213 (e.g., suitable for plugging into an electrical outlet) or other power source such as a battery.

To install the disclosed recirculating flow control systems 200*a*, 200*b*, if a house or building has an existing recirculation line, the flow switch 212 is installed at a targeted location along a hot water line 207, as illustrated in FIG. 2A, and the recirculation pump 216 is electrically coupled to the recirculating flow controller 210 (e.g., using the pump cable 218). The recirculating flow controller 210 operates to control power to the recirculation pump 216 to turn it on and off. Thus, the disclosed recirculating flow control system 200 can be integrated with a system with an existing recirculation pump. For example, where there is an existing recirculation pump, the flow switch 212 and the recirculating flow controller 210 are installed as described herein so that the recirculating flow controller 210 is electrically coupled to the recirculation pump 216 to control power to the recirculation pump 216. In some embodiments, the recirculation pump can be coupled to the return or colder water line 208, as illustrated in FIG. 2B, such as where there is a recirculating water system and/or a crossover valve 221.

In situations where there is no existing recirculation line, a crossover valve 221 can be installed at any suitable faucet (e.g., at a bathroom sink). In these situations, installation then involves installing the flow switch 212 as described herein, installing the recirculation pump 216 at or near the water heater 201, and operably coupling the recirculation pump 216 and the flow switch 212 to the recirculating flow controller 210.

Figure 3A:
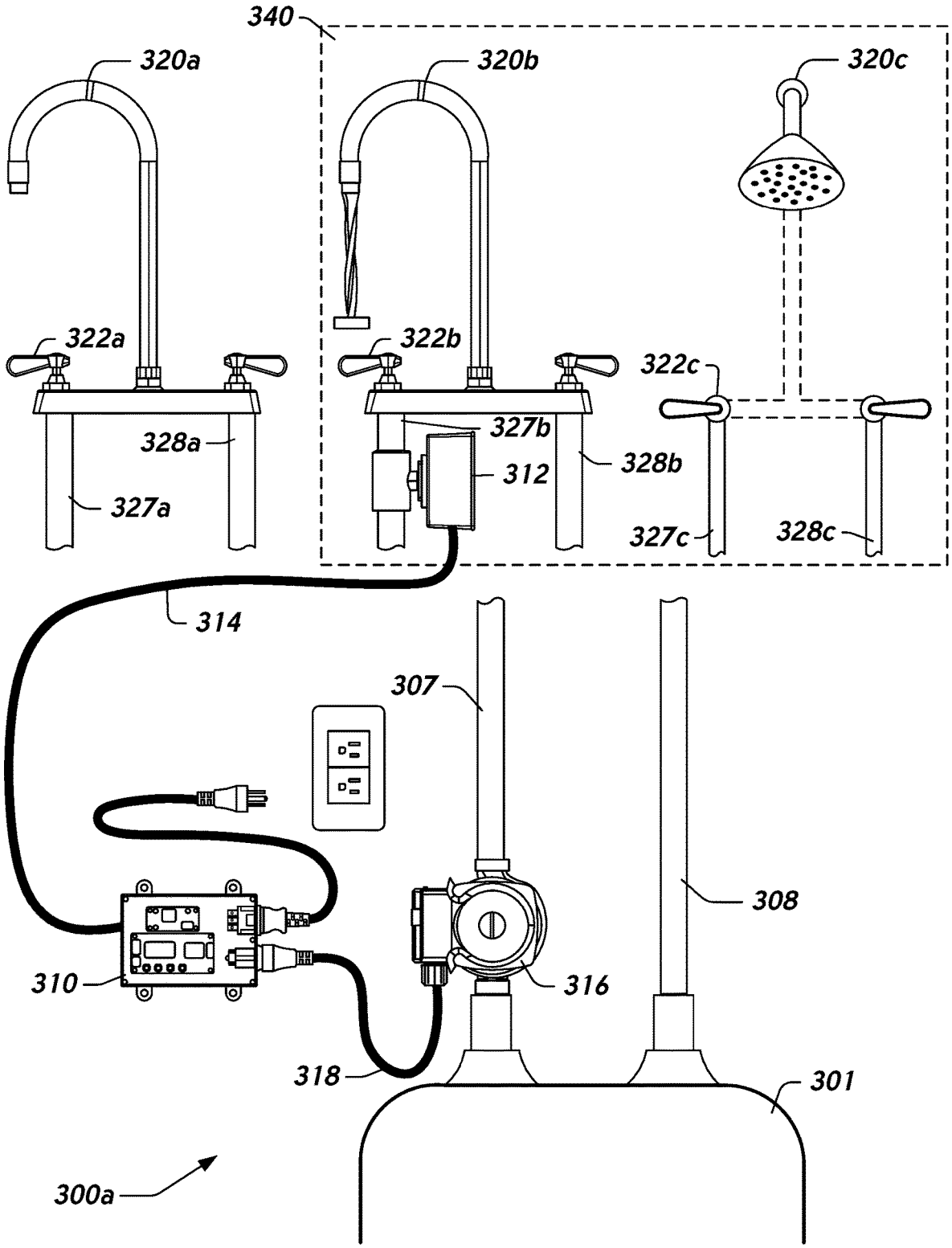
FIGS. 3A and 3B illustrate an example recirculating flow controller, a flow switch, and a recirculation pump that is activated by turning on a particular hot water faucet to control hot water delivery to a targeted fixture or room.
Figure 3B:
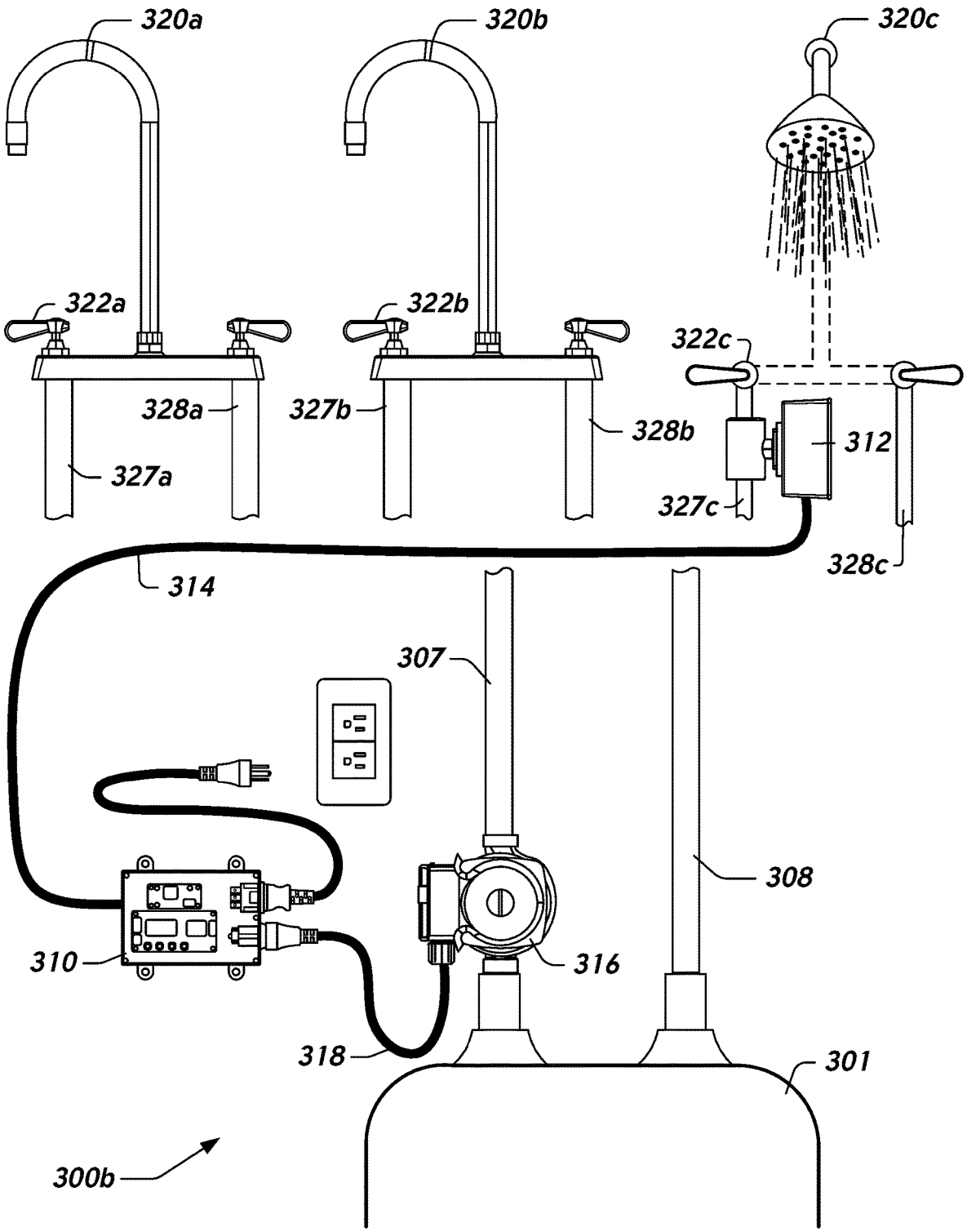

FIGS. 3A and 3B illustrate an example recirculating system 300*a* with a recirculating flow controller 310, a flow switch 312, and a recirculation pump 316 that is activated by turning on a particular hot water faucet to control hot water delivery to a targeted fixture or room. The recirculating flow controller 310 is similar to the recirculating flow controllers 110, 210 described herein. The flow switch 312 is similar to the flow sensor 112 and the flow switch 212 described herein. The recirculation pump 316 is similar to the recirculation pumps 116, 216 described herein.

FIG. 3A illustrates the recirculating flow controller 310, flow switch 312, and recirculation pump 316 that are configured to control hot water recirculation through a water heater 301 via a hot water line 307 and a cold water line 308. The flow switch 312 can be installed at or near a particular water faucet 320*b* or other appliance. Here there are three water faucets 320*a*-320*c*, representing different fixtures (such as sinks and showers). Two water faucets 320*b*, 320*c* are in the same room or building 340. Because the flow switch 312 is coupled to the hot water line 327*b* of the water faucet 320*b*, turning on the hot water using the hot water tap 322*b* causes the flow switch 312 to change state or to provide a signal to the recirculating flow controller 310 through the cable 314. In response to the change in state or signal, the recirculating flow controller 310 begins a recirculation program to control the recirculation pump 316 via the pump cable 318. For example, the recirculating flow controller 310 can provide power to the recirculation pump 316 according to a timed program that is configured to deliver hot water to the water faucets 320*b*, 320*c* in the room or building 340. Thus, turning on the hot water at the sink 320*b* can cause the shower 320*c* to have hot water delivered to it. Consequently, after some time (e.g., at or around termination of the timed program), the user can turn on the hot water tap 322*c* and receive immediate or prompt hot water for a shower. This is advantageous because it allows a user to turn on hot water at a sink (which may be more easily accessible than a shower tap) and receive hot water at the shower without having to run water waiting for the water to heat up.

In addition, because the flow switch 312 is coupled to the hot water line 327*b* and not the hot water line 327*a*, operation of the faucet 320*a* does not initiate the recirculation program at the recirculating flow controller 310. This may be advantageous where it is desirable to initiate the recirculation program only in response to turning on hot water at a particular faucet. The recirculation pump 316 can be installed on the hot water outlet 307. However, in some embodiments, the recirculation pump 316 can be installed elsewhere in the recirculation system, such as on the cold water line 308.

This configuration may be particularly advantageous where a water heater in a main building provides hot water to another building. For example, in a house with a casita (e.g., a separate dwelling on the same property), the flow switch 312 can be installed in the casita (e.g., the building 340) so that when the hot water tap 322*b* is turned on, hot water can be circulated to the casita. This may be desirable because it may take a long time for hot water to be delivered from the main house to the casita in typical circumstances. Thus, less water is wasted waiting for hot water to arrive at the building 340. In some implementations, the flow switch 312 can be installed at a common inlet to the building 340, thus enabling any tap (e.g., taps 322*b*, 322*c*) to be used to begin the recirculation program.

FIG. 3B illustrates a recirculating system 300*b* that is similar to the recirculating system 300*a* but with the flow switch 312 coupled to a shower 320*c* that is not necessarily in the same room as another faucet (e.g., the faucets 320*a*, 320*b*). In some embodiments, the shower 320*c* can be replaced with any other suitable faucet or appliance. In this configuration, turning on the water tap 322*c* causes the recirculation program to initiate, as described herein, whereas turning on the water taps 322*a*, 322*b* does not cause the recirculation program to initiate. This may be advantageous where it is desirable to control the recirculation program using a particular faucet, fixture, or appliance.

This configuration may be particularly advantageous where faucets 320*a*, 320*b* are near the water heater 301 and the shower 320*c* is relatively far from the water heater 301. Thus, turning on taps 322*a*, 322*b* does not begin the recirculation program because hot water is typically delivered relatively quickly to the corresponding faucets 320*a*, 320*b*. However, turning on the tap 322*c* does begin the recirculation program, delivering hot water to the shower 320*c* without wasting as much cold water down the drain waiting for hot water.

Figure 4:
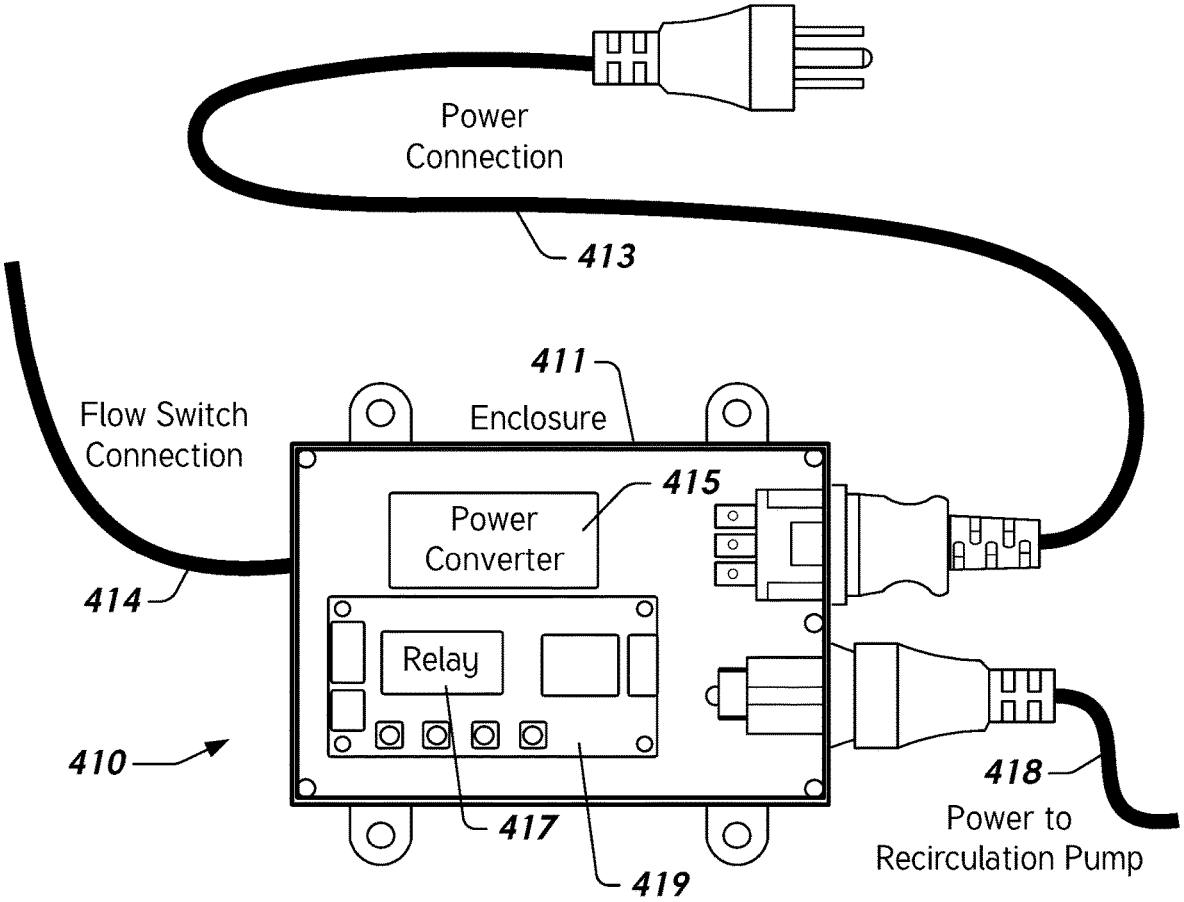
FIG. 4 illustrates internal components of an example recirculating flow controller.

FIG. 4 illustrates internal components of an example recirculating flow controller 410. The recirculating flow controller 410 is similar to the recirculating flow controllers 110, 210, 310 described herein. The recirculating flow controller 410 includes an enclosure 411 that houses electronics 419 that include a relay 417 and a power converter 415. The electronics 419 are configured to control power delivery from a power connection 413 to a recirculation pump via the pump cable 418 using the power converter 415. The power connection 413 can receive power from an electrical outlet and/or from another power source (e.g., a battery that can be housed within the enclosure 411, which may obviate the need for the external power connection 413). The electronics 419 are also configured to sense a change in a flow switch (e.g., a change from an open circuit to a closed circuit or a change in electrical signal) via the switch cable 414 or to receive a signal from a flow sensor or flow switch. In response to this sensed change or received signal, the relay 417 triggers initiation of a recirculation program that delivers power to the recirculation pump via the pump cable 418 using the power converter 415.

The recirculating flow controller 410 is configured to receive power from a power source, such as an outlet (e.g., 110/120 V) or battery, and to output a DC voltage through the power converter 415 for the relay 417. The recirculating flow controller 410 can be configured to pass through the voltage received from the power source to provide that power to the recirculation pump. Thus, to install the recirculating flow controller 410, the recirculation pump can be plugged into the recirculating flow controller 410, the recirculating flow controller 410 can be plugged into the wall, and the flow sensor or flow switch can be plugged into the recirculating flow controller 410. In some embodiments, the disclosed configurations enable the recirculation pump to be directly coupled to the recirculating flow controller 410 without changing any configuration or characteristics of the recirculation pump, advantageously enabling the recirculating flow controller 410 to be installed in systems with existing recirculation pumps.

The electronics 419 include components to execute the recirculation program. For example, the electronics 419 can include a timer that controls how long to run the recirculation pump according to the recirculation program. In some embodiments, the duration is at least 1 minute, at least 2 minutes, at least 3 minutes, or at least 4 minutes. In some embodiments, the duration is less than 10 minutes, less than 8 minutes, or less than 6 minutes. The timer can be configured to provide a sufficient duration so that hot water is delivered to a targeted or desired faucet, such as the faucet furthest from the water heater.

Figure 5:
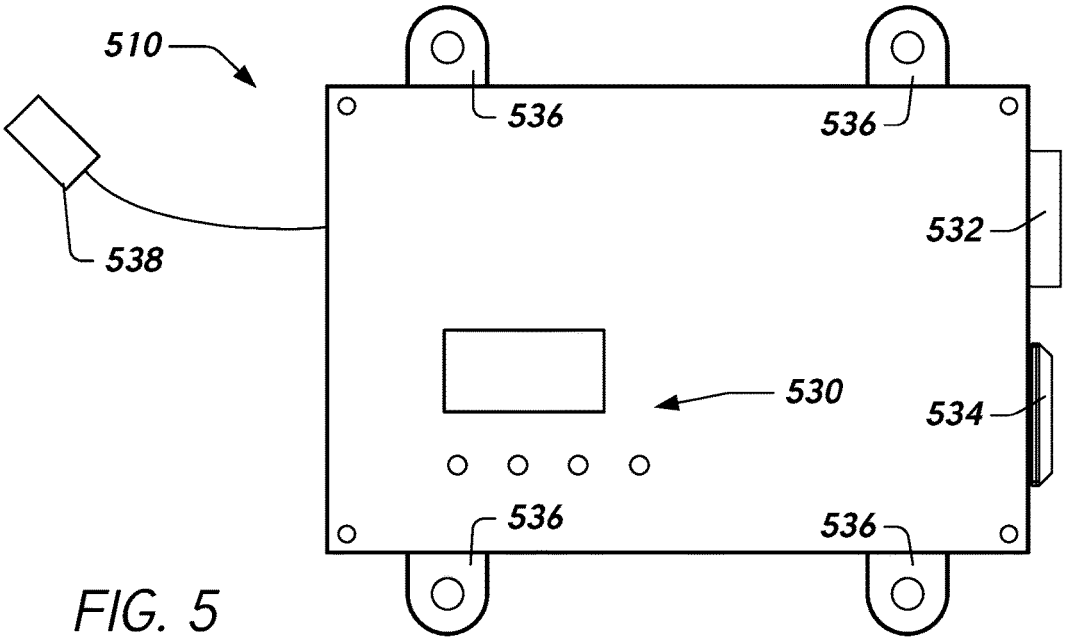
FIG. 5 illustrates external components of an example recirculating flow controller.

FIG. 5 illustrates external components of an example recirculating flow controller 510. The recirculating flow controller 410 is similar to the recirculating flow controllers 110, 210, 310, 410 described herein. The external components can be part of an enclosure, such as the enclosure 411 described herein with reference to FIG. 4. In some embodiments, the enclosure is about 3.5 inches by 5 inches by 2 inches. The enclosure can include feet 536 or other similar features to facilitate installation or mounting to a surface, such as a wall or to a water heater or recirculation pump.

The recirculating flow controller 510 includes user interface features 530 such as an LED or display screen, one or more buttons or switches, and the like. In some embodiments, the user interface features 530 includes four buttons such as a button to switch between recirculation programs (e.g., where a recirculation program corresponds to when a relay is turned on, when a relay is turned off, and/or an amount of time to turn on the relay). For example, a recirculation program can be configured to turn on the relay an amount of time after the flow sensor or flow switch indicates flow in the hot water line. As another example, a recirculation program can be configured to turn on the relay for a predetermined amount of time. These features of a recirculation program can be combined. Another pair of buttons can be configured to provide incrementing (up) and decrementing (down) features for programming the recirculating flow controller 510. Another button can be configured to initiate a configuration mode and/or to enter information into a recirculation program.

The recirculating flow controller 510 includes a power interface 532 to receive a power cable, such as the power cable 413 described herein with reference to FIG. 4. The recirculating flow controller 510 includes a pump interface 534 configured to receive a pump cable, such as the pump cable 418 described herein with reference to FIG. 4. The recirculating flow controller 510 includes a flow switch interface 538 configured to receive a switch cable, such as the switch cable 414 described herein with reference to FIG. 4.

Figure 6:
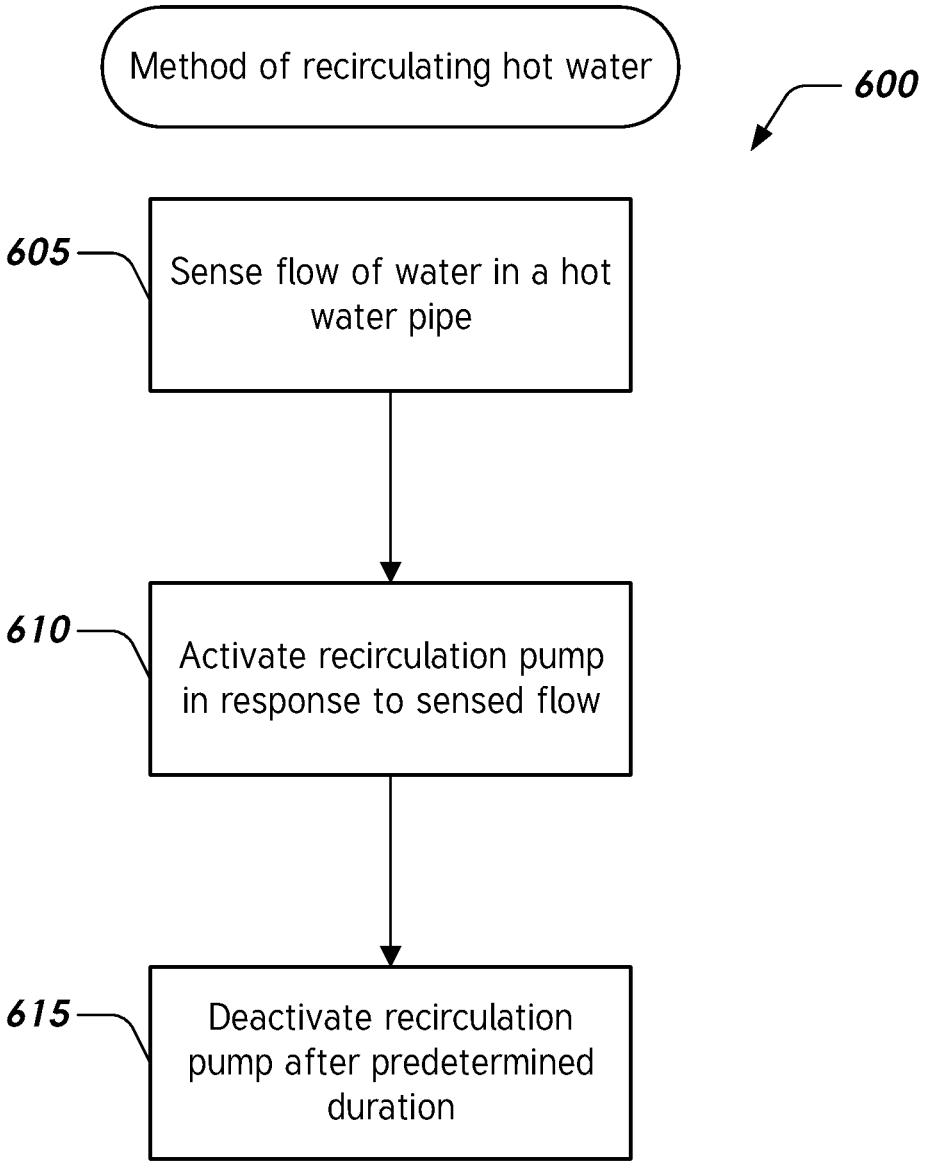
FIG. 6 illustrates a flow chart of an example method of recirculating hot water on an as-needed basis.

FIG. 6 illustrates a flow chart of an example method 600 of recirculating hot water responsive to turning on hot water at a faucet. At block 605, water flow is sensed in a hot water pipe. The flow can be sensed by a flow switch, such as the flow switches described herein, or a flow sensor, such as the flow sensors described herein. Water flow is initiated by turning on a hot water tap at a faucet, for example. At block 610, a recirculating flow controller activates a recirculation pump in response to the flow being sensed. The recirculating flow controller can be any of the recirculating flow controllers described herein. The recirculation pump can be activated immediately upon sensing water flow or activation can be delayed a predetermined amount of time. At block 615, the recirculating flow controller shuts off the recirculation pump after a predetermined duration. The predetermined duration can be configured to ensure that hot water arrives to a desired or targeted faucet. Turning on the recirculation pump, turning off the recirculation pump, and the duration of running the recirculation pump can be controlled by a recirculation program, as described herein.

As described herein, the disclosed recirculating flow controllers can operate without complex configurations that depend on external inputs, such as a button being pushed or a smartphone application being activated to initiate a program. The disclosed recirculating flow controllers can be configured to operate based on a user turning on a faucet sufficiently long to cause water to flow in a hot water line. Thus, the simplicity of the disclosed recirculating flow controllers is advantageous for both the user and the person installing the recirculating flow controllers in a recirculating system.

The disclosed recirculating flow controllers provide a recirculation pump relay that is triggered when a hot water faucet is opened anywhere in a home or other such building or in a particular room or building, as described herein. The recirculation pump relay can be programmed for an amount of time that brings hot water to the faucet. The recirculation pump relay is enclosed in an enclosure, such as a plastic box. In some implementations, the recirculating flow controllers include a time relay switch. The disclosed recirculating flow controllers and associated components provide a simple method of circulating water throughout the home or other building. These implementations eliminate any need for installing a manual switch in the building to activate a recirculation system. The user simply opens and shuts a hot water faucet which turns on the recirculation pump (due to the interactions between the flow switch and the recirculating flow controller). The user waits while water recirculates back to the water heater, delivering hot water to the faucet without wasting water down the drain.

The disclosed recirculating flow controllers advantageously do not include complex wiring, radio-frequency switches, or the like to activate the recirculation pump. Any hot water valve in the system can be configured to be the element that activates the recirculation system through the disclosed recirculating flow controllers. The disclosed recirculating flow controllers can be installed in any home or business where there is a hot water faucet and an existing recirculating pipe system. In some implementations, a crossover valve can be installed where there is no recirculating system to convert it to a recirculating system. The disclosed recirculating flow controllers can prevent a water heater (e.g., tankless or a tank type water heater) from unnecessary startups that waste energy and water.

The present disclosure describes various features, no single one of which is solely responsible for the benefits described herein. It will be understood that various features described herein may be combined, modified, or omitted, as would be apparent to one of ordinary skill. Other combinations and sub-combinations than those specifically described herein will be apparent to one of ordinary skill, and are intended to form a part of this disclosure. Various methods are described herein in connection with various flowchart steps and/or phases. It will be understood that in many cases, certain steps and/or phases may be combined together such that multiple steps and/or phases shown in the flowcharts can be performed as a single step and/or phase. Also, certain steps and/or phases can be broken into additional subcomponents to be performed separately. In some instances, the order of the steps and/or phases can be rearranged and certain steps and/or phases may be omitted entirely. Also, the methods described herein are to be understood to be open-ended, such that additional steps and/or phases to those shown and described herein can also be performed.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or" in reference to a list of two or more items, that word covers all of the following interpretations of the word: any of the items in the list, all of the items in the list, and any combination of the items in the list. The word "exemplary" is used exclusively herein to mean "serving as an example, instance, or illustration." Any implementation described herein as "exemplary" is not necessarily to be construed as preferred or advantageous over other implementations.

The disclosure is not intended to be limited to the implementations shown herein. Various modifications to the implementations described in this disclosure may be readily apparent to those skilled in the art, and the generic principles defined herein may be applied to other implementations without departing from the spirit or scope of this disclosure. The teachings of the invention provided herein can be applied to other methods and systems, and are not limited to the methods and systems described above, and elements and acts of the various embodiments described above can be combined to provide further embodiments. Accordingly, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A hot water recirculation system comprising:

a flow switch operably coupled to a first hot water line that delivers hot water to a first water fixture, the flow switch configured to change state responsive to a flow rate of water through the first hot water line and to not change state responsive to a flow rate of water through a hot water line different from the first hot water line, the flow switch configured to present a first state responsive to the flow rate of water through the first hot water line being less than a threshold flow rate and to present a second state responsive to the flow rate of water through the first hot water line being greater than or equal to the threshold flow rate;

a recirculation pump configured to circulate water through a return line to a water heater; and a recirculating flow controller operably coupled to the flow switch and to the recirculation pump, the recirculating flow controller configured to activate the recirculation pump responsive to the flow switch changing state from the first state to the second state to deliver hot water to the first water fixture.

2. The system of claim 1 wherein the state change of the flow switch corresponds to changing between an open circuit and a closed circuit.

3. The system of claim 1 wherein the state change of the flow switch corresponds to providing an electric signal to the recirculating flow controller.

4. The system of claim 1 further comprising a switch cable that connects the flow switch to the recirculating flow controller.

5. The system of claim 1 further comprising a pump cable that connects the recirculation pump to the recirculating flow controller.

6. The system of claim 1 wherein the recirculating flow controller is configured to pass power received from a wall outlet to the recirculation pump to activate the recirculation pump.

7. The system of claim 1 wherein the recirculating flow controller is configured to activate a recirculation program responsive to the flow switch changing state.

8. The system of claim 7 wherein the recirculation program includes activating the recirculation pump after a predetermined amount of time.

9. The system of claim 7 wherein the recirculation program includes deactivating the recirculation pump after a predetermined amount of time.

10. The system of claim 7 wherein the recirculation program includes running the recirculation pump for a predetermined amount of time.

11. The system of claim 1, wherein the recirculating flow controller does not deactivate the recirculation pump responsive to the flow switch changing state from the second state to the first state.

12. A method for recirculating hot water, the method comprising:

sensing, with a flow sensor coupled to a first hot water pipe, a flow rate of water through the first hot water pipe that delivers hot water to a first water fixture, the flow sensor configured to not change state responsive to water flowing in a hot water line different from the first hot water line;

presenting, with the flow sensor, a first state responsive to the flow rate of water through the first hot water line being less than a threshold flow rate;

presenting, with the flow sensor, a second state responsive to the flow rate of water through the first hot water line being greater than or equal to the threshold flow rate;

responsive to the flow switch changing state from the first state to the second state, activating a recirculation pump coupled to a water recirculation system that includes the hot water pipe to deliver hot water to the first water fixture; and deactivating the recirculation pump according to a recirculation program.

13. The method of claim 12, wherein the recirculation program includes a timed duration for running the recirculation pump.

14. The method of claim 13, wherein the timed duration is greater than 1 minute.

15. The method of claim 14, wherein the timed duration is less than 10 minutes.

16. The method of claim 12, wherein the recirculation program includes a predetermined amount of time to wait between sensing the flow of water and activating the recirculation pump.

17. The method of claim 12, wherein the recirculation pump does not deactivate responsive to the flow switch changing state from the second state to the first state.

* * * * *